US005565647A

United States Patent [19]

Kerdraon et al.

[11] Patent Number: 5,565,647

[45] Date of Patent: Oct. 15, 1996

[54] WARHEAD WITH SEQUENTIAL SHAPE CHARGES

[75] Inventors: Alain Kerdraon; Richard Durand, both of Bourges, France

[73] Assignee: Giat Industries, Versailles Cedex, France

[21] Appl. No.: 706,679

[22] Filed: May 24, 1991

[51] Int. Cl.[6] ..... F42B 12/18

[52] U.S. Cl. ..... 102/476; 102/210; 102/308

[58] Field of Search ..... 102/210, 308, 102/310, 476

[56] References Cited

U.S. PATENT DOCUMENTS

| | | | |
|---|---|---|---|
| 4,004,515 | 7/1980 | Mallory et al. | 102/308 |
| 4,793,256 | 12/1988 | Webb | 102/210 |
| 4,854,240 | 8/1989 | Hirsch et al. | 102/476 |

FOREIGN PATENT DOCUMENTS

| | | | |
|---|---|---|---|
| 193427 | 9/1986 | European Pat. Off. | 102/476 |
| 999974 | 2/1952 | France | 102/476 |
| 2552869 | 4/1985 | France | 102/476 |
| 2559896 | 8/1985 | France | 102/476 |
| 2581749 | 11/1986 | France | 102/476 |
| 3010917 | 10/1981 | Germany | 102/476 |
| 3918513 | 4/1990 | Germany | 102/476 |

*Primary Examiner*—Harold J. Tudor
*Attorney, Agent, or Firm*—Oliff & Berridge

[57] ABSTRACT

This invention involves a warhead, for use against armor containing several reactive stages, specifically, an anti-tank warhead, of a type comprising shape charges acting sequentially from front to rear and separated by protective elements. It includes:

a front module containing at least two tandem-mounted shape charges (1, 2) whose caliber is between 25 and 50% of the caliber of the warhead, with a delay of 100 to 500 microseconds between their respective initiations; and a main charge (3) whose caliber is the same as that of the warhead and which is initiated after a delay of 200 to 2000 microseconds after initiation of the rear charge in the front module.

Applications involve shells, rockets or missiles intended to attack multi-stage, spaced, composite or reactive armor.

7 Claims, 1 Drawing Sheet

WARHEAD WITH SEQUENTIAL SHAPE CHARGES

TECHNICAL FIELD

This invention involves a warhead which can be used specifically with shells, rockets or missiles against armor, in particular, armor on tanks or armored vehicles comprising several reactive stages.

BACKGROUND

The recent appearance of this latter type of reactive armor, made up of alternating explosive layers, called active protection, and layers of dense armor, for example, steel, glass or composite and affording a greater measure of protection than is obtained with main armor, has led to the development of warheads comprising shape charges operating sequentially from front to rear, and which are called "tandem mounted". This type of configuration proves very effective in the following conditions:

1) the first charge to detonate, called the forward charge, must be sufficient to destroy all overprotection;
2) the time delay between action of the two charges must be long enough to allow the interference capability of the active protection to be inhibited; and, finally,
3) detonation of the forward charge must have no or little damaging effect on the destructive capability of the main charge, which activates subsequent to the forward charge.

In fact, conditions 1 and 3 are mutually contradictory: if the destructive capacity of the forward charge is increased, then, especially if the lapse between detonation of the two charges is too long (for example, more than 0.5 ms) the inevitable result will be an alteration of the main charge's performance.

French Patents Nos. 2,559,896 and 2,581,749 illustrate this contradiction: they describe a low effectiveness forward charge making possible a long time lapse without excessive additional weight whereas French Patent No. 2,552,869 discloses a high-performance forward charge combined with a short time lapse and/or massive protection.

For use against multi-layer armor, other warheads are known which comprise shape charges which act in succession, but from back to front, as illustrated, for example, by U.S. Pat. No. 4,004,515. This type of configuration implies the use of forward shape charges in sections which are only slightly effective because of damage done to them by rear charges which are initiated first, despite complex tubular structures whose purpose is to guide the rear charges' jets through the forward charges' liners.

SUMMARY OF THE INVENTION

This invention helps to remedy the drawbacks encountered with the earlier embodiments by putting forth a warhead with shape charges acting sequentially from front to rear, which satisfies all three abovementioned conditions, thus ensuring optimal effectiveness, specifically against armor with several reactive stages.

The invention thus involves a warhead for use against armor comprising several reactive stages, specifically, an anti-tank warhead of a type comprising shape charges acting sequentially from front to rear and separated by protective elements, characterized by the fact that it includes a front module comprising at least two tandem-mounted shape charges whose caliber is less than that of the warhead, for example, 0.25 to 0.50 of the latter, with time lapses between initiation of these charges of 100 to 500 microseconds, and a main charge whose caliber is the same as that of the warhead and which is initiated 200 to 2000 microseconds after initiation of the forward module's rear charge.

Preferably, the protective elements between two contiguous charges, each of which contains an explosive load and a safety-and-arming device, will comprise the safety-and-arming device of one of the charges.

According to one species, the protective elements comprise an interface of cellular material located between the explosive load and the safety-and-arming device of the charge involved.

Preferably, the time lapses between initiation of the various charges are achieved through a time-delay system comprising on the one hand one of the safety-and-arming devices, which forms a recoiling mass and crushes a piezoelectric generator, and, on the other hand, a component made of compressible material placed inside the area between the safety-and-arming device and the piezoelectric generator.

Another purpose of this invention is to achieve a warhead as described above, additionally characterized by the fact that the mass of the front module is 10 to 35% of that of the main charge.

BRIEF DESCRIPTION OF THE DRAWINGS

Other advantages obtained with this invention become apparent in the following description of an embodiment, with no limitativeness, with reference to the drawing in which.

DETAILED DESCRIPTION OF PREFERRED EMBODIMENTS

Figure 1:
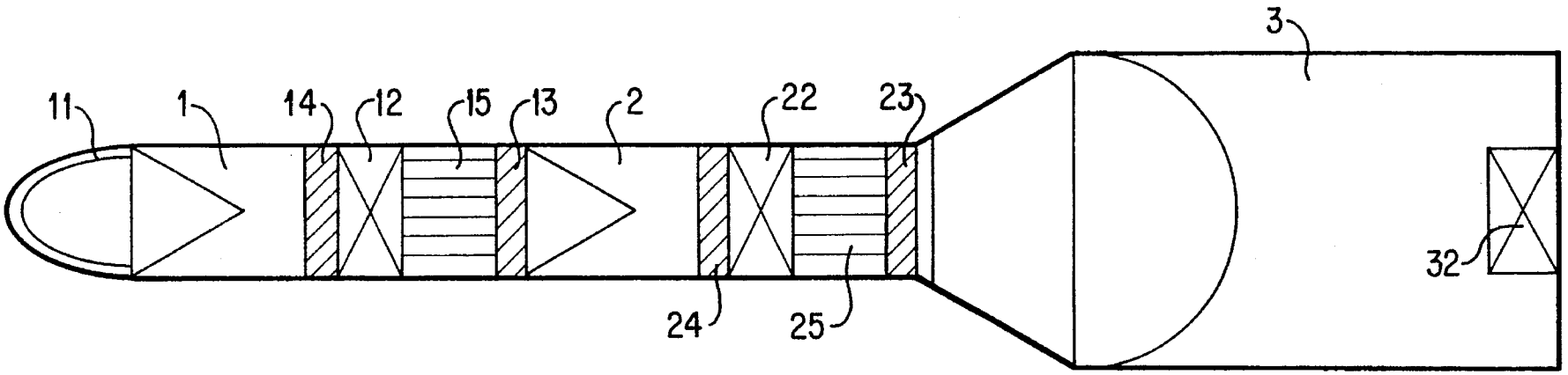
FIG. 1 represents a diagrammatic cross-section of a warhead configured according to this invention and specifically adapted to destroy two-stage reactive armor.

Initiation of the front module's first charge 1 is achieved through the action of the warhead contact (switch) 11 and through its safety-and-arming device 12.

The detonation of charge 1 achieves, first of all, the generation of the first blast, which begins the destruction of two of the overprotection stages, then, secondly, the initiation of charge 2 through the action of the first safety-and-arming device 12 on the piezoelectric generator 13 and the second safety-and-arming device 22. The safety-and-arming device 12 functions as a recoiling mass and as protection between the charges according to the configuration described in French Patent No. 2,559,896. An interface of cellular material 14, for example, a sintered metallic material of a volumetric weight of 1500 to 3000 kg\m$^3$, is enough to damp the detonation effect of charge 1 on the safety-and-arming device 12. The time it takes the recoiling mass 12 to cross foam cylinder 15 determines the time delay between the initiation of charges 1 and 2. For a delay of 200 microseconds, the foam 15 allows a gain of 5 to 20% over the distance between the two charges (according to the foam's hardness), while affording additional protection between the two charges. Preferably, the foam should be of organic material (polyethylene or polyurethane) and its density should be lower than or equal to 250 kg\m$^3$ and the material's compressive strength should be such that its volume would diminish by less than 5% under $10^6$ pascals pressure but should diminish by at least 90% under $10^8$ pascals pressure.

The detonation of charge 2 occurs 200 microseconds after that of charge 1; this interval is calculated in such a way that the second blast builds on the destructive effects of charge 1 but is also calculated so that the second charge will not suffer from the disturbing effects resulting from the relaxation of the overprotection armor caused by its penetration by the first blast. Moreover, the recoil of the protection between the two charges, comprising the safety-and-arming device 22 and the cellular interface 24, cause the initiation of the main charge 3 through the action of the piezoelectric generator 23 and the safety-and-arming device 32. As before, the interval between initiation of charges 2 and 3 is determined by the time it takes the foam 25 to compress.

Detonation of the main charge 3 comes 500 microseconds after the initiation of the front module; this ensures piercing of the tank's main armor and destruction of the tank.

As contrasted with a single forward charge, such a front module allows:

for a given weight of constant jet kinetic energy explosive used in a forward charge, a gain of over 100 to 300% is achieved in the duration of the attack on composite pre-armor. Conversely, there is a reduction of the negative effect on the main charge generated by the tandem mount: diminution of dynamic pressure and, above all, the approximately 50% reduction of dynamic thrust;

for a given destructive effect, the weight of needed explosive can be greatly reduced. For example, to destroy composite protection a conventional shape charge of about 80 mm caliber is required and its explosive would weigh more than 600 grams. The same effect can be obtained using a front module equipped with two 35 mm caliber charges with explosives weighing two times 60 grams representing a weight advantage of 80%.

We claim:

1. A warhead comprising:

a front module containing at least a front shape charge and a rear shape charge whose caliber is less than a caliber of the warhead, and means for causing said rear shape charge to initiate 100 to 500 microseconds after said front shape charge, a main shape charge tandomly located behind the front module whose caliber is the same as the caliber of the warhead and means for causing said main charge to initiate 200 to 2000 microseconds after the rear charge in the front module, and protective elements located between said shape charges.

2. A warhead according to claim 1, wherein each said shape charge has an explosive load and a safety-and-arming device, at least one of said protective elements comprising the safety-and-arming device of one of the shape charges.

3. A warhead according to claim 1, wherein at least one of said protective elements comprises an interface of cellular material located between an explosive load and a safety-and-arming device of each of the shape charges.

4. A warhead according to claim 1, wherein said means for causing said rear shape charge to initiate after said front shape charge comprises a time-delay system for establishing the interval between initiation of said shape charges comprising a safety-and-arming device which forms a recoiling mass intended to crush a piezoelectric generator and an element of compressible material between the safety-and-arming device and the piezoelectric generator.

5. A warhead according to one of claim 1, wherein the calibers of the shape charges in the front module are between 0.25 and 0.50 of the caliber of the warhead.

6. A warhead according to one of claim 1, wherein a mass of the front module is between 10 and 35% of a mass of the main shape charge.

7. A warhead according to claim 1, wherein said means for causing said main charge to initiate after the rear charge in the front module comprises a time-delay system for establishing the interval between initiation of said shape charges comprising a safety-and-arming device which forms a recoiling mass intended to crush a piezoelectric generator and an element of compressible material between the safety-and-arming device and the piezoelectric generator.

* * * * *